United States Patent [19]

Delcroix et al.

[11] 4,209,703

[45] Jun. 24, 1980

[54] SOURCE FOR PLASMA OF LARGE TRANSVERSE SECTION AND CONSTITUTING AN ION ACCELERATOR

[76] Inventors: Jean L. Delcroix, 37 rue des Longs Pres, 92100 Boulogne; Jean M. Peyraud, L'"Agrianthe", 06230 Villefranche, both of France

[21] Appl. No.: 512,316

[22] Filed: Oct. 1, 1974

[30] Foreign Application Priority Data

Oct. 2, 1973 [FR] France ..... 73 35098

[51] Int. Cl.[2] ..... H01J 27/00; F03H 3/00; H05H 1/00

[52] U.S. Cl. ..... 250/423 R; 60/202; 250/505; 313/199; 313/361

[58] Field of Search ..... 60/202, 203; 250/423, 250/424, 426, 505; 176/7, 39; 315/111.4, 111.5, 111.6; 313/359, 360, 361, 362, 194, 199

[56] References Cited

U.S. PATENT DOCUMENTS

| | | | |
|---|---|---|---|
| 2,512,538 | 6/1950 | Baker | 313/194 |
| 2,806,161 | 9/1957 | Foster, Jr. | 250/423 |
| 3,102,384 | 9/1963 | Bennett | 60/202 |
| 3,382,359 | 5/1968 | Lee | 250/424 |

*Primary Examiner*—S. C. Buczinski

*Attorney, Agent, or Firm*—Haseltine, Lake & Waters

[57] ABSTRACT

A plasma source constituting an ion accelerator operating in the presence of an intense magnetic induction for obtaining plasma of large transverse section and comprising a chamber having an inlet for gas and a device to produce electrical discharge at high frequency in the chamber to form a plasma from the gas. A plurality of parallel channels are disposed in axial extension from the chamber and a magnetic induction coil surrounds the channels for producing the intense magnetic induction in a direction parallel to the channels.

9 Claims, 4 Drawing Figures

SOURCE FOR PLASMA OF LARGE TRANSVERSE SECTION AND CONSTITUTING AN ION ACCELERATOR

FIELD OF THE INVENTION

The present invention relates to a plasma source of large transverse section and constituting an ion accelerator, notably operating in the presence of an intense magnetic induction.

The invention also relates in non-limiting fashion to the utilization of this plasma source, particularly as a propulsion means for a space projectile and in the realization of apparatus for the treatment of various surfaces by ionic bombardment.

BACKGROUND

It is well known that conventional plasma sources, such as at the interior of hollow cathodes do not enable obtaining a plasma flow of large transverse section in the presence of a magnetic field. In the known arrangements, the transverse diffusion of the plasma is, in fact, prevented by the magnetic field.

Furthermore, in the known arrangements, direct acceleration of the plasma by geometric effect cannot be contemplated as it is conducted in non-homogeneous magnetic fields.

SUMMARY OF THE INVENTION

An object of the invention is to obviate the disadvantages noted above while providing a plasma source constituting at the same time an ion accelerator capable of operating in the presence of an intense magnetic field and particularly, permitting the obtention of a plasma having a substantial transverse section and a substantial discharge of ionized particles.

Since the plasma has a large transverse section, the invention is particularly applicable to propulsion means in space operating under the thrust action produced by the plasma particles.

The invention is also applicable to the treatment of relatively large regions of various surfaces such as semiconductors and the like.

According to the invention, the plasma source comprises a chamber associated with means for producing the plasma and means for introducing a gas into the chamber, a series of parallel channels communicating with the interior of said chamber, and a magnetic induction coil disposed around the assembly of the channels in a manner such that the magnetic induction is parallel to the channels.

The direction of magnetic induction is such that partially ionized gas particles produced at the interior of the chamber diffuse towards the outside of the source while passing through the channels without undergoing collision thereat if the magnetic field is sufficiently intense.

The assembly of the channels therefore constitutes a filter which is opaque to neutral particles and is transparent to the charged particles.

The channels also give to the produced plasma a large transverse section corresponding to the particular section of the channel assembly.

The plasma source according to the invention is also an ion accelerator on which the ions are accelerated by ambipolar diffusion. The energy source in these processes is preferably the thermal agitation of the electrons. The energy of the electrons is transformed into an orderly directive energy of the ions. The energy thus released is accompanied by a reduction in temperature of the electrons and an acceleration of the ions.

The acceleration of the ions is particularly adapted to particular utilization of the invention.

According to one advantageous embodiment, the chamber is cylindrical and the channel assembly is disposed in a cylinder axially mounted against the chamber, said channels being bounded for a series of parallel walls disposed in said cylinder.

Such structure is particularly simple to construct and has a number of advantages, particularly from the point of view of easy alignment of the channels with the direction of magnetic induction which constitutes one of the essential conditions whereby the channels allow free passage of the charged particles.

According to a preferred embodiment, the length of the channels is greater than their minimum transverse dimension and the latter is much lower than the means free path of the neutral molecules of the utilized gas.

These dimensional characteristics of the channels enable the filter constituted thereby to substantially totally prevent the passage of neutral particles. There is thus obtained a plasma essentially constituted by the charged particles.

Other features and advantages of the invention will further appear in the following description to be given in conjunction with the appended drawings.

DETAILED DESCRIPTION

Figure 1:
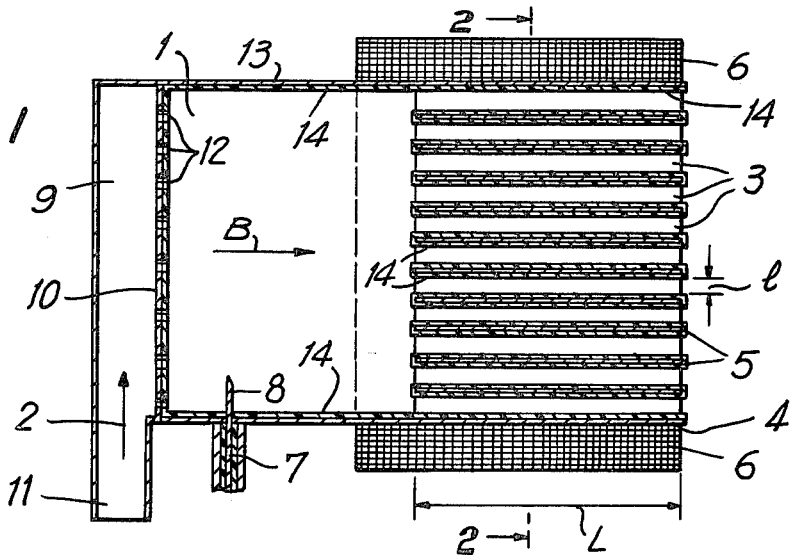
FIG. 1 is a schematic longitudinal sectional view of a plasma source according to the invention.
Figure 2:
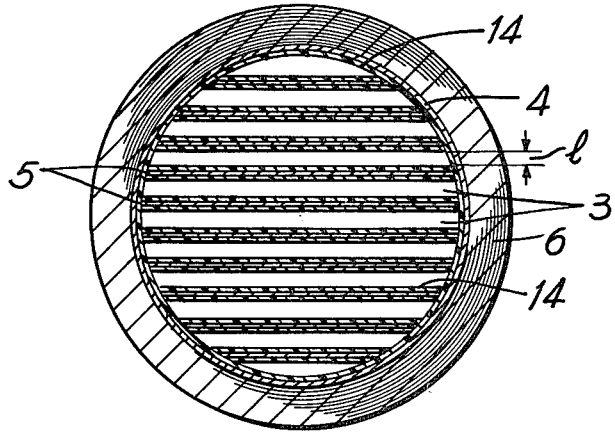
FIG. 2 is a sectional view taken on line 2—2 in FIG. 1.

In the embodiment of FIGS. 1 and 2 there is seen a plasma source according to the invention constituting at the same time an ion accelerator and comprising a chamber 1, means for introducing gas 2 into the interior of the chamber 1, and a series of parallel channels 3 which are open at their extremities and communicate with the interior of the chamber 1.

The chamber 1 is cylindrical and the assembly of channels 3 is surrounded by a cylinder 4 which extends axially beyond the chamber 1. The channels are separated from one another by a series of parallel walls 5 disposed within cylinder 4.

A magnetic induction coil 6 is disposed around the cylinder 4 surrounding the channels 3 and part of the chamber 1 such that magnetic induction B is parallel to the axis of cylinder 4 i.e. parallel to channels 3.

The length L of the channels is substantially greater than their minimum transverse dimension l which corresponds to the distance between adjacent walls 5. The dimension on l is selected so that it is less than the mean free path of the neutral molecules constituting the utilized gas 2.

The channel assembly constitutes an opaque filter for the neutral particles and a transparent filter for the charged particles produced by ionization in the interior of chamber 1.

The means for ionizing the gas 2 introduced into the chamber 1 is constituted by any conventional arrangement for producing an electrical discharge of high frequency in the interior of the chamber. In the embodiment of FIG. 1, the arrangement comprises an armor-plated conductor 7 whose free extremity 8 is disposed in the interior of the chamber and is of pointed shape. The conductor is connected to a conventional high frequency source (not shown).

In the embodiment in FIG. 1, the means for the introduction of gas 2 into the chamber 1 comprises a second chamber 9 fixed to the bottom 10 of chamber 1, and a tubular element 11 opening into chamber 10 to supply the gas 2 thereto, the bottom 10 having holes 12 formed therein. The holes 12 have a diameter smaller than the wavelength corresponding to the resonant frequency of the chamber 1 under the action of the high frequency discharge. The dimensioning of holes 12 is such that the waves produced in the interior of the chamber 1 do not propogate into the chamber 9. Also, the holes 12 act as a throttle in the passage of the gas 2 from chamber 9 and thereby limit the pressure of the gas in the interior of chamber 1.

Figure 3:
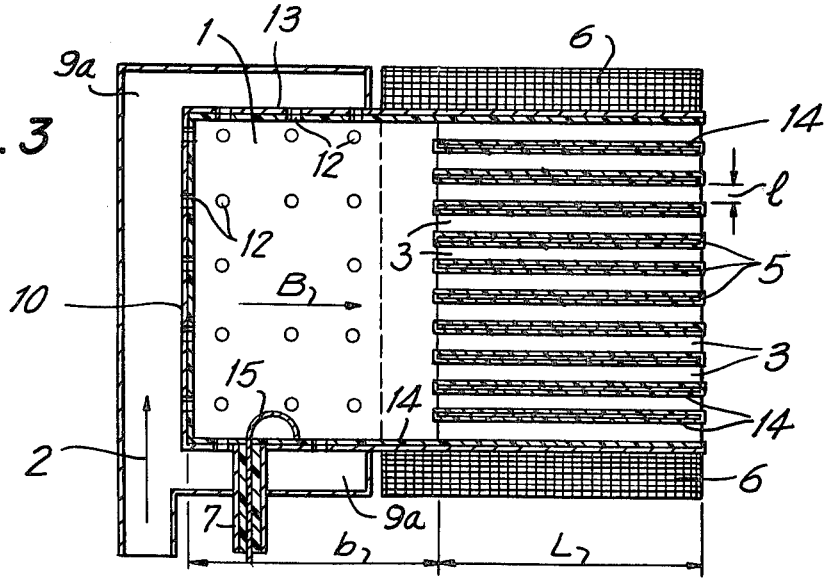
FIG. 3 is a schematic longitudinal sectional view of a modification of the plasma source.

In the embodiment of FIG. 3, chamber **9*a* for introduction of the gas also surrounds the lateral wall 13 of chamber 1 and this is formed with holes 12*a* for the passage of gas 2. The disposition of the holes 12 and 12*a* and their regular distribution on bottom 10 and lateral wall 13 of chamber 1** permit radial adjustment of the distribution of the plasma density which is advantageous in the utilization provided by the invention.

The lateral wall 13 and the bottom 10 of chamber 1 and the walls 5 delimiting the different channels 3 are made of conductive material and preferably are constituted by a very conductive metal, such as copper, gold, silver or their alloys.

It is further seen that the wall 13 and the bottom 10 of chamber 1 and walls 4 and 5 are internally coated by a layer 14 of an electrically insulating material, such as, polytetrafluoroethylene, or an insulative ceramic. This insulation provides considerable reduction in the capture of ionized particles by the metal constituting the chamber and the channels.

It is further seen in FIG. 3 that conductor 7 for the high frequency discharge, terminates on the interior of chamber 1 by a loop 15 constituting a mounting known as "a magnetic coupling". This arrangement for the production of high frequency discharge can be replaced by a mounting (not shown) known as "a wave guide" provided with a window opening into the chamber 1.

The plasma source according to the invention can operate with various gases, such as hydrogen, helium, argon, methane and ethylene at absolute pressures between $10^{-3}$ and $10^{-6}$ Torr. The output of the source is particularly significant for large magnetic induction B and, in particular, can operate in the presence of a magnetic induction B equal or greater than about 1 Kg-gauss.

The range of the high frequency discharge is in conventional hyperfrequencies whose wavelengths are between 1mm and 30 cm.

There can be obtained, for example, a plasma having a diameter of about 10 cm by means of a source having the following characteristic dimensions:

$l$ = about 2 cm $L/l$ = about 10 diameter of holes 12 and **12*a*** = about 1 mm.

With such a source, there can be obtained a directional energy of the ions between 10 and 100 eV with a flux power varying from $10^{-2}$ to 1 A $cm^2$.

The parameters defining the operation of the plasma source according to the invention are the following:

(a) Input conditions:

flow rate of the neutral particles: $Q_o$ (part·$cm^{-2}$·$sec^{-1}$)

thermal velocity of the neutral particles: $W_o$(cm·$sec^{-1}$)

power of the high frequency discharge: P (b) Plasma characteristics density of the neutral particles: $n_o$($cm^{-3}$)

thermal velocity of the electrons: $w_e$ electronic density in the chamber: $n_e$ electrical high frequency field in the chamber: E output of ionization: x (1) Calculation of the flow rate of the neutral particles leaving the source:

In the embodiments according to the invention $d>L>l$, and the mean free path d of the neutral particles is much greater than the transverse dimension l of the channels 3. The flow rate of the neutral particles is given by the relation of Knudsen, wherein $$Q'_o = \frac{l}{L}\ \frac{n_o w_o}{4} = Q_o(1-x)$$

This relation shows that the flow rate of the neutral particles from the source is lowered as $L/l$ is increased.

(2) Discharge equations:

The production of electrons can be expressed as follows:

$$n_e n_o s_i w_e\, b = \frac{1}{Z}\, n_e\, w_e \left(\frac{m_e}{m_i}\right)^{\frac{1}{2}} \qquad (1)$$

wherein:

is the effective section for ionization of neutral particles by the electrons,

Z is a numerical coefficient between 1 and 4, b is the length of the chamber (see FIG. 3) and $m_e$ and $m_i$ respectively represent the masses of a gas particle and an electron.

The transformation energy of the neutral particles in plasma is expressed as $$n_e n_o \overline{s_i w_e} b = x Q_o$$

The energy of the high frequency field is given by the following expression $$P = f\frac{W}{Q} + \tfrac{1}{2} R\, \overline{s_p E^2}\, V \qquad (2)$$

wherein:

f is the pulsation of the wave associated with the electromagnetic field E, $s_p$ is the complex conductivity of the plasma W is the mean energy stored in the chamber, and Q is the overvoltage thereof The energy of the electrons is given by the following expression:

$$\tfrac{1}{2}R\,\overline{s_p E^2}\;V = 2\frac{me}{mi}\left(\frac{3}{2}\,n_e\,K\,T_e\right)f_e V + xQ_oS(KE_i + \frac{3}{2}\,KT_e) \quad (3)$$

wherein:

$f_e$ is the frequency of elastic collisions of the electrons,

K is a coefficient which represents the effect of the non-ionized inelastic collisions, $T_e$ is the electronic temperature, and S is the transverse section of the chamber.

The electronic temperature $T_e$ is calculated as a function of x by means of equation (1). This equation can be put in dimensionless form if the form of the electronic distribution is known. This latter being, in first Maxwellian approximation, given by the following expression:

$$\overline{s_i w_e} = \overline{w_e} s_i(\max) g(s) \quad (4)$$

wherein:

$s_i$ (max) is the maximum effective section of ionization, and g(s) is a function of the temperature reduction $s=(kTe/E_i)$ which depends on the nature of the utilized gas.

By combining equation (4) in equation (1) there is obtained:

$$G(1-x)g(s)=1 \quad (5)$$

which can be transformed to be $$G = ZN_o b\, s_i(\max)\left(\frac{m_e}{m_i}\right)^{\frac{1}{2}}$$

wherein:

$N_o$ is equal to $$\frac{n_o}{1-x}$$

The parameter G is the essential dimension which determines the operation of the discharge. G comprises, in effect, the geometric parameters of the apparatus (b, L/l), the input conditions ($Q_o$, $w_o$) and the gas properties (si(max), $m_i$).

(3) The energy calculation is as follows:

Equation (2) can be written:

$$P=P_o+P_p$$

wherein:

$p_o$ is the power dissipated in the walls of the chamber and is equal to $$\frac{f}{Q}\left(\frac{\epsilon_o E^2 V}{2}\right),$$

and $P_p$ is the power imparted to the plasma and is equal to:

$$P_p = \tfrac{1}{2}\,\epsilon_o f_{ep}\frac{f_p^2}{f^2}\,E^2 V$$

wherein:

$f_{ep}$ is the frequency of collision of the electrons with the walls and $f_p$ is the pulsation of the plasma.

From the above $(P_p/P_o)=Q(f_{ep}/f)=(f_p^2/f^2)$ whereby $$P = P_p\left(1 + Q\frac{f_{ep}}{f}\cdot\frac{f_p^2}{f^2}\right.$$

It can also be shown that $$Q\cdot\frac{f_{ep}}{f}\cdot\frac{f_p^2}{f^2} = \frac{1}{4\pi ZQ}\left(\frac{m_e}{m_i}\right)^{\frac{1}{2}}\frac{b}{r_o}\;\frac{f^3}{Q_o c^2}\;\frac{1}{x} \quad (6)$$

wherein:

$r_o=2.8\times10^{-13}$ cm is the radius of an electron and

C is the speed of light.

The application of formula (6) gives:

$$n=Cx^{-1} \text{ wherein } C=C_1(10^3/Q)(b/10)\cdot(f/10^9)\cdot(10^7/Q_o)$$

wherein:

$C_1=2.3\times10^{-2}$ in helium and $C_1=7.4\times10^{-2}$ in argon.

Equation (3) can be written:

$$P_p=P_p^{el.}+P_p^{inel.}$$

(el=elastic; inel=inelastic)

By simple calculation it can be shown that $P_p^{el.}$ is much less than $P_p$ inel.

Under these conditions and combining equations (2), (4) and (5)

$$P = Q_o S E_i (K + 3/2\, s)(x + C)$$

and using equation (5) relating X and S $$P = Q_o S E_i (K + 3/2\, s)\,[1 + C - (Gg(s))^{-1}] \quad (7)$$

Figure 4:
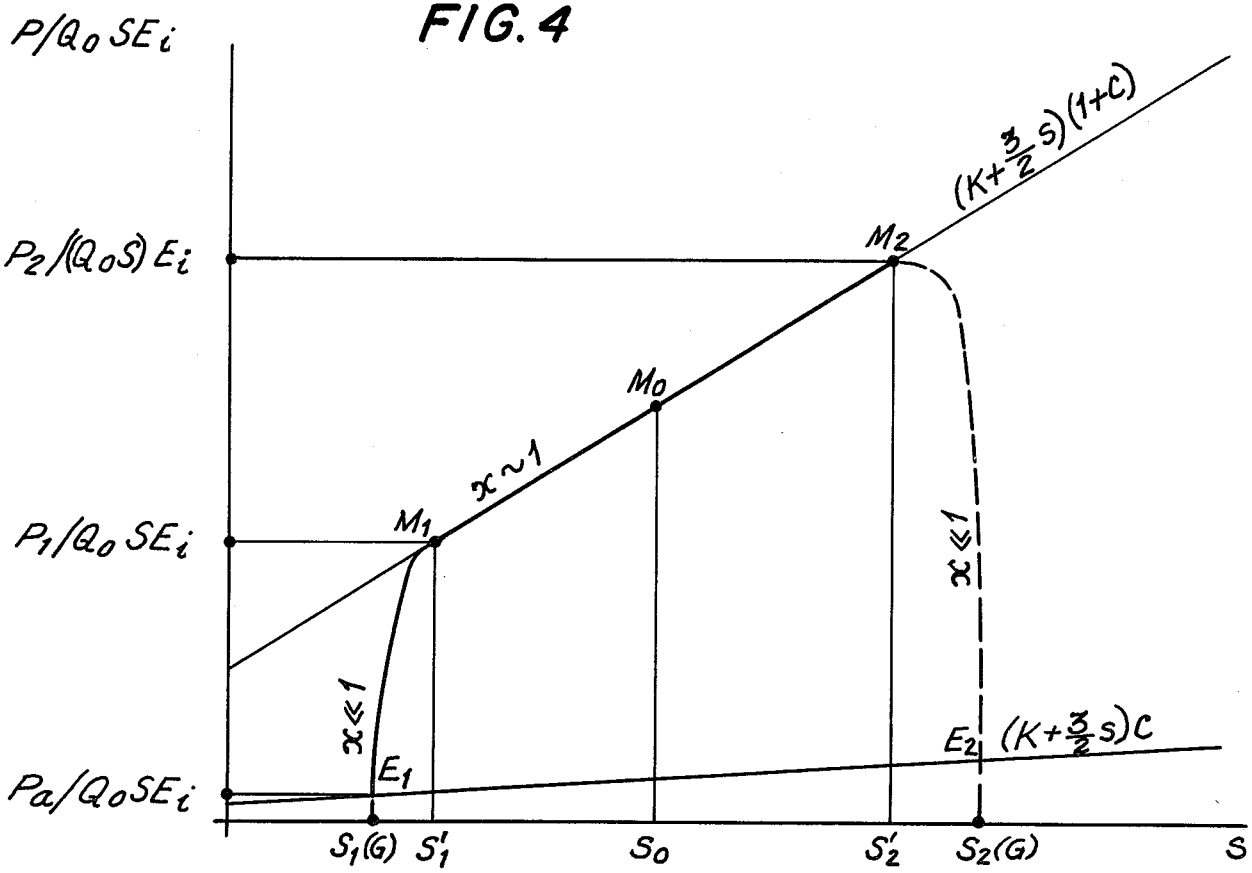
FIG. 4 is a graphical representation showing the variation of a proportional part of the total electrical power imparted to the plasma as a function of the proportional part to the electron temperature of the latter.

In the curve shown in FIG. 4, the ordinate is $P/Q_oSE_i$ and the abscissa is reduced electronic temperature S. It is assumed that G greatly exceeds 1. There is seen from the curve three operating domains:

(a) the region $M_1M_2$ where the ionization output x is very close to unity. This type of regime extends to points $M_1$ and $M_2$ whose reduced temperatures $s'_1$ and $s'_2$ are very close to the extinction temperatures of discharge $s_1(G)$ and $s_2(G)$. Furthermore, the greater the constant G, the closer X is to unity and the closer $s'_1$ and $s'_2$ approach the temperature of extinction. At the two limiting points $M_1$ and $M_2$, the limited powers correspond as follows:

$P_1$ is approximately equal to $Q_oSE_i\,[K + 3/2\, s_1(G)](1 + C)$ $P_2$ is approximately equal to $Q_oSE_i\,[K + 3/2\, s_2(G)](1 + C)$ The power $P_1$ is a minimum power below that at which discharge can only function with small values of X and the power $P_2$ is a maximum power at the time at which the discharge cannot be maintained in a permanent state.

(b) the region $E_1M_1$ where the ionization output X varies from 0 to 1. This region is limited at point $E_1$ whose temperature is the extinction temperature. The corresponding power is:

$$P_a = Q_o SE_i [K + 3/2\, s_i(G)]\, C$$

which is the threshold power for which the discharge begins to ignite with a very low ionization output.

(c) the region $M_2E_2$ where the ionization output returns from 1 to 0. This region corresponds to an unstable operating regime.

Considering the instability of the region $M_2E_2$ it is seen finally that the reduced electronic temperature is determined in singular manner from P by equation (7). This is an increasing function of P. The function conditions utilized are those where X is about 1; these are represented by the region $M_1M_2$ and one can select, according to the magnitude desired, an optimum point of operation in the following manner:

point $M_1$=minimum energy consumption point $M_O$=maximum ionization output point $M_2$=maximum velocity of plasma ejection.

In order to furnish some idea of the order of magnitude of the necessary powers, Table 1 hereafter indicates the values of the power applied to the plasma $P_p$, the power dissipated in the walls of the chamber (or radiated) in operating near the point Mo (X)=1, S=2, Z=4, K=(3/2), f=$f_p$, Q=$10^3$, B=10cm, S=$10^2$cm$^2$:

TABLE 1

| Gas | $Q_o$ | $10^{17}$ | $10^{18}$ | $10^{19}$ |
|---|---|---|---|---|
| He | $P_p$ (watts) | $1.8 \times 10^2$ | $1.8 \times 10^3$ | $1.8 \times 10^4$ |
| | $P_o/P_p$ | $4.6 \times 10^{-2}$ | $1.4 \times 10^{-2}$ | $4.6 \times 10^{-3}$ |
| Ar | $P_p$ (watts) | $1.2 \times 10^2$ | $1.2 \times 10^3$ | $1.2 \times 10^4$ |
| | $P_o/P_p$ | $3 \times 10^{-2}$ | $10^{-2}$ | $3 \times 10^{-3}$ |

In practice, it is seen that Po is always very much smaller than $P_p$ such that the total power can be effectively taken as $P_p$.

The results in Table 2 hereafter are obtained in the case of a source operating with the following characteristics:

Q=$10^{18}$($1.6\times10^{-1}$A/cm$^2$)

s=10 cm$^2$ b=5 cm

L/l=10 f=$10^{10}$Hz

Q=$10^3$ and assuming Z=4, Go=1, So=2 and a discharge rate of $10^{18}$ atoms/cm$^2$·sec.

TABLE 2

| Gas | G | $1-x_{(max)}$ | C | s | $S_2$ | $P_a$ (watts) | $P_1$ (watts) | Peritical (watts) | $P_2$ (watts) |
|---|---|---|---|---|---|---|---|---|---|
| He | $2 \times 10^1$ | $5 \times 10^{-2}$ | $1.1 \times 10^{-2}$ | 0.25 | >10 | $\eta 1$ | 10 | $1.7.10^2$ | $>\eta 10^3$ |
| $A_r$ | $1.5 \times 10^3$ | $7 \times 10^{-4}$ | $3.7 \times 10^{-3}$ | 0.12 | >10 | 0.25 | 60 | $1.2 . 10^2$ | $>10^3$ |

The preceding description shows that as a consequence of the significant properties of the plasma source according to the invention, the following properties can be restated:

high ionization output (X is about 1);

substantial plasma discharge (greater than $10^{-1}$ A/cm$^2$);

capability of distributing the plasma over a substantial transverse section;

high energy output from the source.

The calculations also show that the plasma ions can be accelerated to very high energy levels. These can attain and even exceed 100 eV. This acceleration is effected by ambipolar diffusion in which the energy source, constituted by the thermal agitation of the electrons, is transformed into transmitted directional energy while the electrons are cooled.

The combination of the aforementioned advantages applicable to the plasma source of the invention is particularly adapted to a spatial propulsion means with high thrust.

In such embodiment, the plasma source can be utilized in association with a gas reservoir and means for the production of electrical energy for feeding the coil of the magnetic inductor. The latter can be of any suitable known type and particularly an electrical feed source utilizing magnets-hydrodynamic action or solar energy.

In the application of apparatus for the treatment of various surfaces by ionic bombardment, the plasma source according to the invention is utilized in association with means for producing relatively powerful vacuum in a chamber between the source and the sample to be treated. The feed of the induction coil can be effected by conventional means.

Due to the capability of distributing the plasma over a substantial transverse section, the production of large plasma discharges, and the substantial ion acceleration obtained by the plasma source of the invention, it is possible to treat large sample surfaces in a single operation. A preferred use of the plasma source of the invention is the treatment of semi-conductors.

Although the invention has been described in connection with particular embodiments thereof, it is to be understood that the invention is not limited thereto, but in contrast includes all variations and modifications within the scope of the appended claims.

What is claimed is:

1. A plasma source constituting an ion accelerator comprising a chamber, means for introducing a gas into said chamber, means for producing a plasma from the gas, an assembly of a plurality of parallel elongated channels having inlets communicating with the interior of said chamber, each channel having a length greater than its minimum transverse dimension, the latter being much smaller than the mean free path of the neutral particles constituting the utilized gas, the transverse dimension of said channels being of a size to prevent passage of neutral particles while allowing passage of the charged particles produced by ionization in said chamber and means for producing a magnetic induction disposed around the assembly of channels such that the magnetic induction is parallel to said channels

2. A plasma source as claimed in claim 1 wherein said chamber is cylindrical, said channel assembly including a cylindrical casing axially disposed with respect to the cylindrical chamber, and a plurality of spaced parallel walls disposed in said casing and defining said channels therebetween.

3. A plasma source as claimed in claim 1 wherein said means for producing the plasma comprises means for producing an electrical discharge of high frequency in the interior of said chamber.

4. A plasma source as claimed in claim 3 comprising a second chamber at least in part adjacent the first said chamber, said first chamber including a wall separating the first and second chambers, said wall having holes of a diameter less than the wavelength corresponding to the resonant frequency of said first chamber under the effect of the high frequency discharge.

5. A plasma source as claimed in claim 4 wherein said channel assembly includes a casing constituted of a highly conductive metal selected from the group consisting of copper, gold, silver and alloys thereof.

6. A plasma source as claimed in claim 5 comprising a layer of electrically insulating material disposed on the interior of said casing.

7. A plasma source as claimed in claim 4 having a magnetic induction of at least 1 kilogauss, said gas being at an absolute pressure of between $10^{-3}$ and $10^{-6}$ Torr, the discharge produced having a frequency corresponding to a wavelength between 1 mm and 30 cm, said channels having a transverse dimension of about 2 cm, the ratio of the length of the channels to their transverse dimension being about 10, and the diameter of said holes being about 1mm.

8. A plasma source as claimed in claim 1 used for the treatment of surfaces by ionic bombardment.

9. A plasma source as claimed in claim 1, wherein said means for producing a magnetic induction is a magnetic induction coil.

* * * * *